US005259181A

United States Patent [19]

Stahlecker et al.

[11] Patent Number: 5,259,181

[45] Date of Patent: Nov. 9, 1993

[54] SPINNING MACHINE SYSTEM

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 5,177

[22] Filed: Jan. 15, 1993

Related U.S. Application Data

[63] Continuation of Ser. No. 814,834, Dec. 31, 1991, abandoned.

[30] Foreign Application Priority Data

Jan. 11, 1991 [DE] Fed. Rep. of Germany ..... 4100618

[51] Int. Cl.[5] ..... D01H 9/18; D01H 13/28

[52] U.S. Cl. ..... 57/308; 57/90; 57/281

[58] Field of Search ..... 57/315, 90, 75, 281, 57/308

[56] References Cited

U.S. PATENT DOCUMENTS

| | | | |
|---|---|---|---|
| 2,481,538 | 9/1949 | Rowedder | 57/315 |
| 2,736,162 | 2/1956 | Steinberger | 57/90 X |
| 3,016,679 | 1/1962 | Rakhorst | 57/315 |
| 3,044,245 | 7/1962 | Casanovas | 57/90 |
| 3,070,948 | 1/1963 | Tsuzuki | 57/315 X |
| 3,816,991 | 6/1974 | Takeuchi et al. | 57/90 |

FOREIGN PATENT DOCUMENTS

| | | | |
|---|---|---|---|
| 817572 | 10/1951 | Fed. Rep. of Germany . | |
| 882068 | 7/1953 | Fed. Rep. of Germany | 57/90 |
| 2335740 | 11/1974 | Fed. Rep. of Germany . | |
| 1183208 | 3/1970 | United Kingdom . | |

*Primary Examiner*—Joseph J. Hail, III

*Attorney, Agent, or Firm*—Evenson, McKeown, Edwards & Lenahan

[57] ABSTRACT

A spinning machine system is disclosed which has at least one spinning machine with spinning stations supplied by sliver fed from a sliver can. The cans are deposited on a platform situated above the spinning machine and constructed as an air-permeable grid construction to facilitate air flow through the spinning room.

10 Claims, 3 Drawing Sheets

Fig. 2
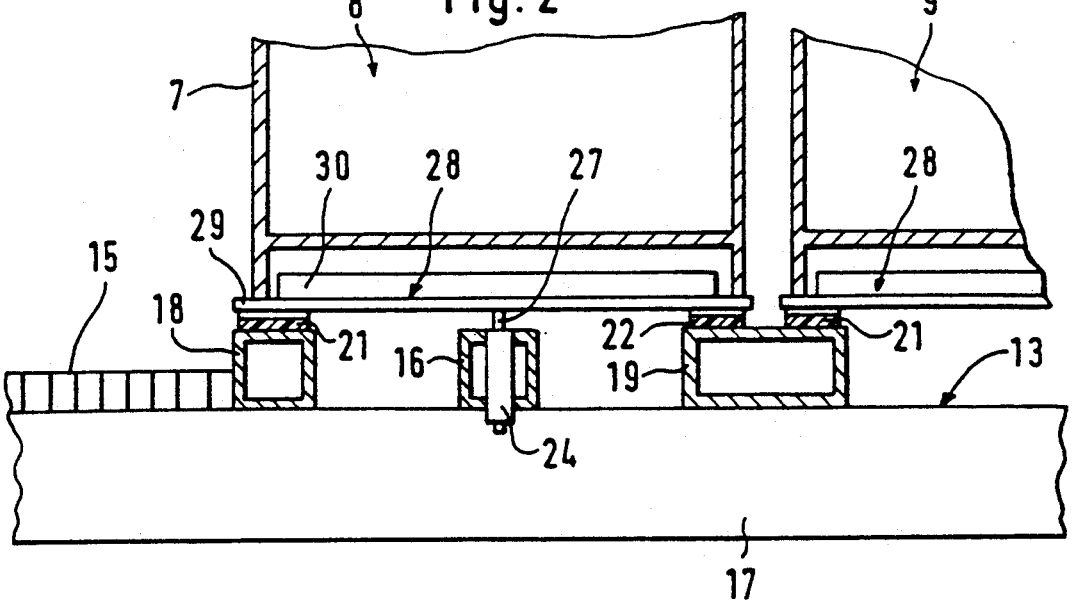
Fig. 3
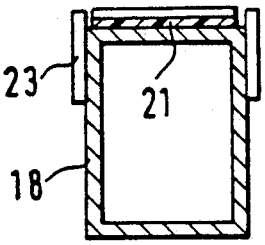
Fig. 4
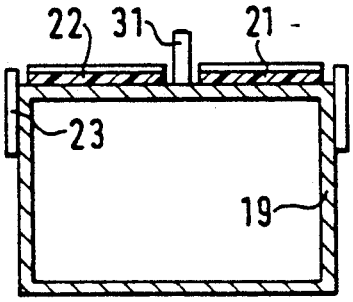
Fig. 5
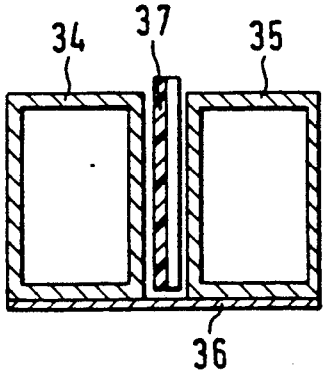
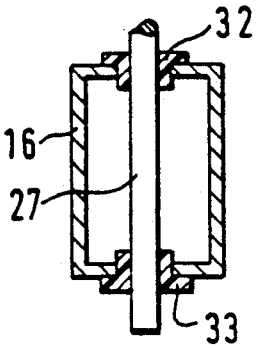
Fig. 6
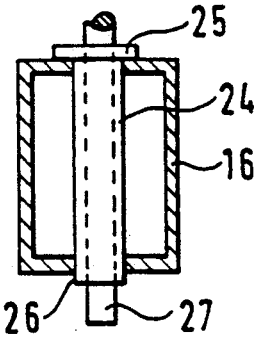
Fig. 7

SPINNING MACHINE SYSTEM

This is a continuation of application Ser. No. 07/814,834, filed Dec. 31, 1991, now abandoned.

BACKGROUND AND SUMMARY OF THE INVENTION

The invention relates a spinning machine system having at least one spinning machine which has a plurality of spinning stations arranged next to one another, to which one can respectively is assigned which contains a sliver to be spun, the cans being deposited in several rows on a platform situated above the spinning machine.

In a known spinning machine system of the initially mentioned type (German Patent Document DE-C 23 35 740), the platform is constructed as a massive floor which is arranged above the spinning machine. Specifically designed guiding tubes for the supply of the slivers to the spinning stations extend through the floor.

It is also known (German Patent Document DE-PS 817 572) to arrange a platform in the shape of a table in an elevated manner in the machine center above the drive assemblies.

It is an object of the invention to improve the operating conditions for a spinning machine system of the initially mentioned type.

This object is achieved in that the platform is constructed as an air-permeable grid construction.

The invention is based on the recognition that a platform above the spinning machines may have the result that the air-conditioning in a spinning room may be impaired. There is the risk that warm air backs up below the platform so that the air-conditioning of the spinning room is not always ensured. By means of the invention, this risk is avoided because of the fact that the platform is constructed such that the air circulation and thus the air-conditioning inside the spinning room is ensured to be largely unimpaired.

In a development of the invention, it is provided that the platform is provided with at least one operating aisle and one depositing area for the cans, the operating aisle consisting essentially of gridirons and the depositing area consisting of longitudinal members which extend in the longitudinal direction of the spinning machines and are spaced away from one another. Such a platform fulfills its function as a platform but impairs the air circulation only very little.

In a further development of the invention, a joint platform is provided for several spinning machines which are set up in parallel with respect to one another. This platform is divided into depositing areas for cans situated centrically above the pertaining spinning machine and into operating aisles situated between them. As a result, it is possible to virtually construct the whole upper area of a spinning room as a platform without any resulting impairment of the air circulation and therefore the air conditioning of the spinning room.

In a further development of the invention, a rotary drive is provided for the cans which is integrated into the grid construction. Such rotary drives, as they were suggested in the older German Patent Applications P 40 38 948.0 and P 40 38 231.1, which are no prior publications, make it possible that a twist is provided to the slivers to be fed so that they have an increased strength. As a result, relatively fine slivers can also be fed along fairly long transport paths without the risk of unintended drafting or the like in the slivers. The feeding of fine slivers, particularly for machines with drafting units, particularly for ring spinning machines, offers the advantage that the drafting units may be simplified. It is possible, for example, to use the conventional three-cylinder drafting unit in the case of a ring spinning machine and nevertheless do without a flyer that is connected in front of it.

Other objects, advantages and novel features of the present invention will become apparent from the following detailed description of the invention when considered in conjunction with the accompanying drawings.

BRIEF DESCRIPTION OF THE DRAWINGS

FIG. 2 is an enlarged vertical sectional view of a portion of the platform of FIG. 1;

FIGS. 3 to 7 are sectional views of longitudinal members for a platform according to FIGS. 1 and 2.

DETAILED DESCRIPTION OF THE DRAWINGS

Figure 1:
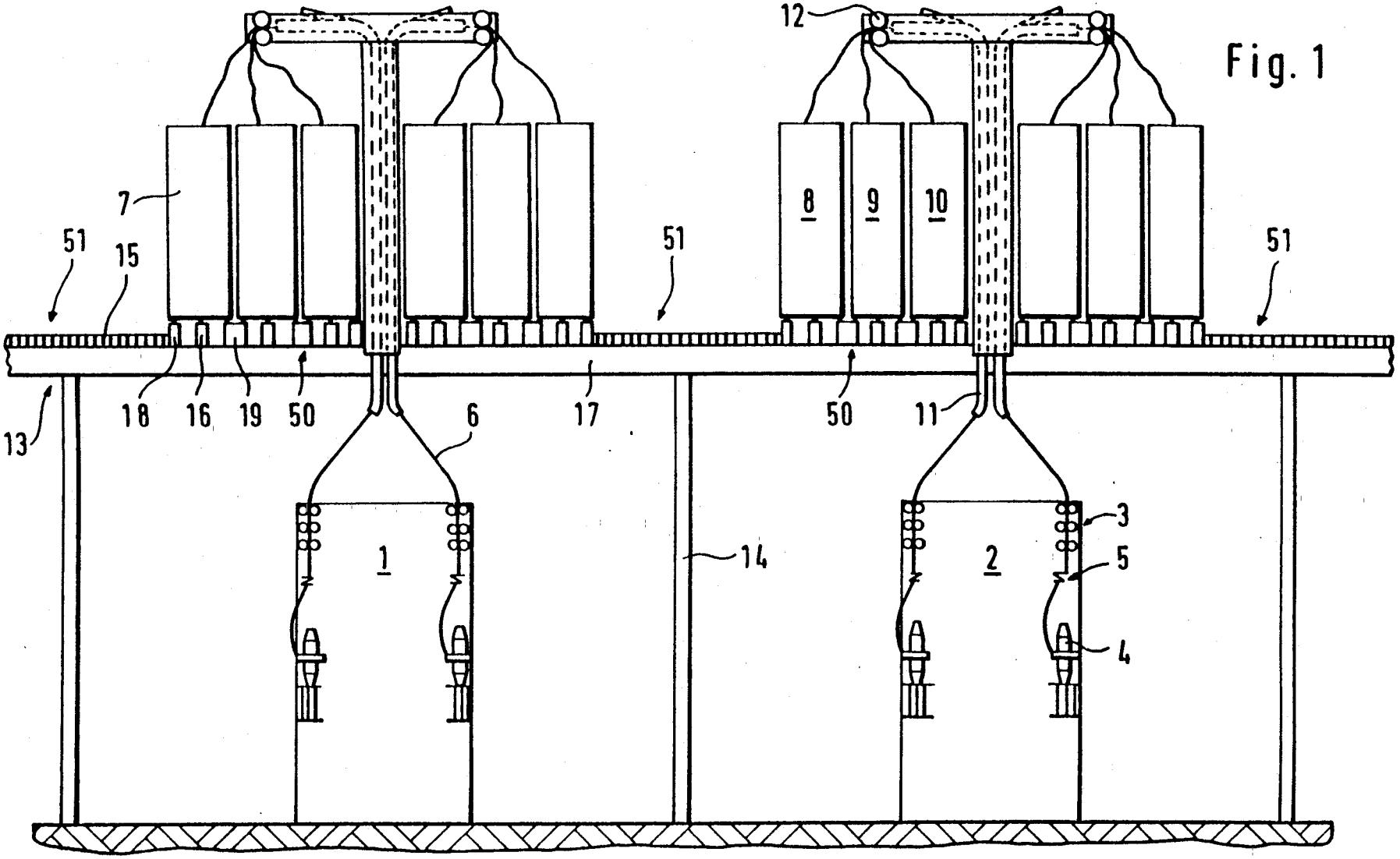
FIG. 1 is a lateral schematic view of a spinning machine system according to the invention having several spinning machines and a joint platform designed as a grid construction.

The schematic sectional view of a spinning machine system shown in FIG. 1 shows two ring spinning machines 1, 2 which in a conventional manner are provided on both sides with a plurality of spinning stations 5 arranged in a row next to one another. Of these spinning stations 5, only the respective drafting units 3 and ring spindles 4 are shown. Instead of ring spinning machines 1, 2, other spinning machines which have spinning stations processing a sliver may also be provided according to other contemplated embodiments of the invention. For example, open-end rotor spinning machines, open-end friction spinning machines, air spinning machines, wind-around spinning machines or the like are suitable for this purpose. These machines may be equipped with spinning stations on one or both sides of the machine.

Each of the spinning stations 5 spins a sliver 6 into a yarn. This sliver 6 is fed in cans 7 which are deposited in several rows 8, 9, 10 above the ring spinning machines 1, 2 on a platform 13. In the shown embodiment, three rows 8, 9, 10 of cans 7 are assigned to each side of the machine. In the case of a smaller machine division, that is, a smaller spacing of the spinning stations in the longitudinal direction of the machine, the number of rows may be increased. By means of withdrawal rollers 12 arranged above the rows 8, 9, 10, the slivers 6 are withdrawn from the cans 7 and are fed by way of guiding tubes 11 to the individual spinning stations 5. Such a guiding tube 11 is provided for each spinning station, the guiding tubes 11 penetrating the platform 13 above the center of the respective ring spinning machine 1, 2.

In order to impair the air circulation and thus the air-condition in a spinning room as little as possible as a result of the platform 13 taking up the whole upper area of the spinning room, the platform 13 is constructed as a largely air-permeable grid construction. The platform 13 comprises cross members 17, which extend transversely with respect to the ring spinning machines 1, 2 and which are carried by supports 14 fastened on the floor. The platform 13 itself is divided into depositing areas 50 for the cans 7, which are each situated above the ring spinning machines 1, 2, and operating aisles 51 which are situated in-between. The operating aisles 51 essentially comprise gridirons 15 which are provided with frames not shown in detail and are mounted on the cross members 17. The depositing areas 50 essentially comprise longitudinal members 16, 18, 19 which each extend in the longitudinal direction of the ring spinning machines 1, 2 and are fastened on the cross members 17 at a mutual distance. As shown in FIG. 1 and also in FIG. 2, a step exists between the operating aisles 51 and the depositing areas 50, by which the depositing areas 50 are at a higher level.

In most cases, it may be expedient to drive the cans 7 to perform rotations about their axes so that the withdrawn slivers 6 receive a true twist during the withdrawal. This true twist, which may be very slight, that is, approximately 2 T/m to approximately 15 T/m (rotations per meter), has the result that also relatively fine slivers are sufficiently strengthened in order to survive, in an undamaged manner, the transport from the spinning cans 7 standing on the platform to the respective drafting units 3. Since the twists of the slivers 6 do not have to be within precise values, because this twist does not enter into the later spun yarn, relatively simply constructed and thus inexpensive rotary drives may be provided. These rotary drives for the cans 7 are integrated into the platform 13. An embodiment of such rotary drives and modifications of it are illustrated in FIGS. 2 to 8 and will be explained in detail in the following.

In the embodiment shown, the longitudinal members 16, 18, 19 are constructed as hollow profiles. Three longitudinal members 16, 18, 19 of this type respectively are assigned to a row 8, 9, 10 of cans 7. The respective central longitudinal member 16 receives pivot pins 27 of can plates 28 (FIG. 2). The bearing of the pivot pins 27 of the can plates 28 may take place corresponding to FIGS. 6 or 7 in the longitudinal member 16 constructed as a rectangular tube. In the case of the embodiment according to FIG. 6, the pivot pin 27 is disposed in two plastic bearing bushes 32, 33 which are fastened from above and below in corresponding recesses of the longitudinal member 16. In the embodiment according to FIG. 7, a one-piece bearing sleeve 24 is provided which is fitted from above through recesses of the longitudinal member 16 in such a manner that it rests from above against the top side of the longitudinal member 16 by means of a ring flange 25. The lower end is provided with a torus-shaped thickening 26 so that the bearing bush 24 is fastened to the longitudinal member 16 by means of a type of clip connection. Similarly, the two bearing bushes 32, 33 may be fastened to the longitudinal member 16 in a clip-type manner.

The can plates 28 each have a circular-disk-shaped base plate 29 on which a centering insert 30 is fastened at a spacing from the exterior edge. The outside diameter of the centering insert 30 is somewhat smaller than the inside diameter of the bottom of the cans 7 so that the cans 7, which with their lower edge stand on the base plate 29, are centered by the centering insert 30. In its outer edge area, the base plate 29 rests in the axial direction on the two ends 21, 22 of the driving belt 20 which in the embodiment shown is developed as a toothed belt. The ends or runs 21, 22 of this driving belt 20, which extend in the longitudinal direction of the machine, drive all cans 7 of one row 8, 9 or 10. In a manner not shown in detail, the driving belts 20 are reversed and driven at one machine end, whereas, at the other machine end, they are only reversed. The runs 21, 22 rest slidingly on the top sides of the longitudinal members 18, 19. In order to guide the runs 21, 22 in the transverse direction, brackets 23 are mounted laterally on the longitudinal members 18, 19, for example, by means of spot welding.

In the shown embodiment, a joint longitudinal member 19 is in each case provided between the two rows 8, 9 and 9, 10 of the cans 7. This longitudinal member 19 is used for the runs 21, 22 of the driving belts 20 of the adjacent rows 8, 9 and 9, 10 jointly as a guide and a support. In order to obtain a lateral guiding for the runs 21, 22, in this case, the above-mentioned brackets 23 are arranged on the outside at regular distances, while, on the inside, on the top side of the longitudinal member 19, which is also constructed as a rectangular member, guiding pins 31 are mounted at regular distances.

Figure 8:
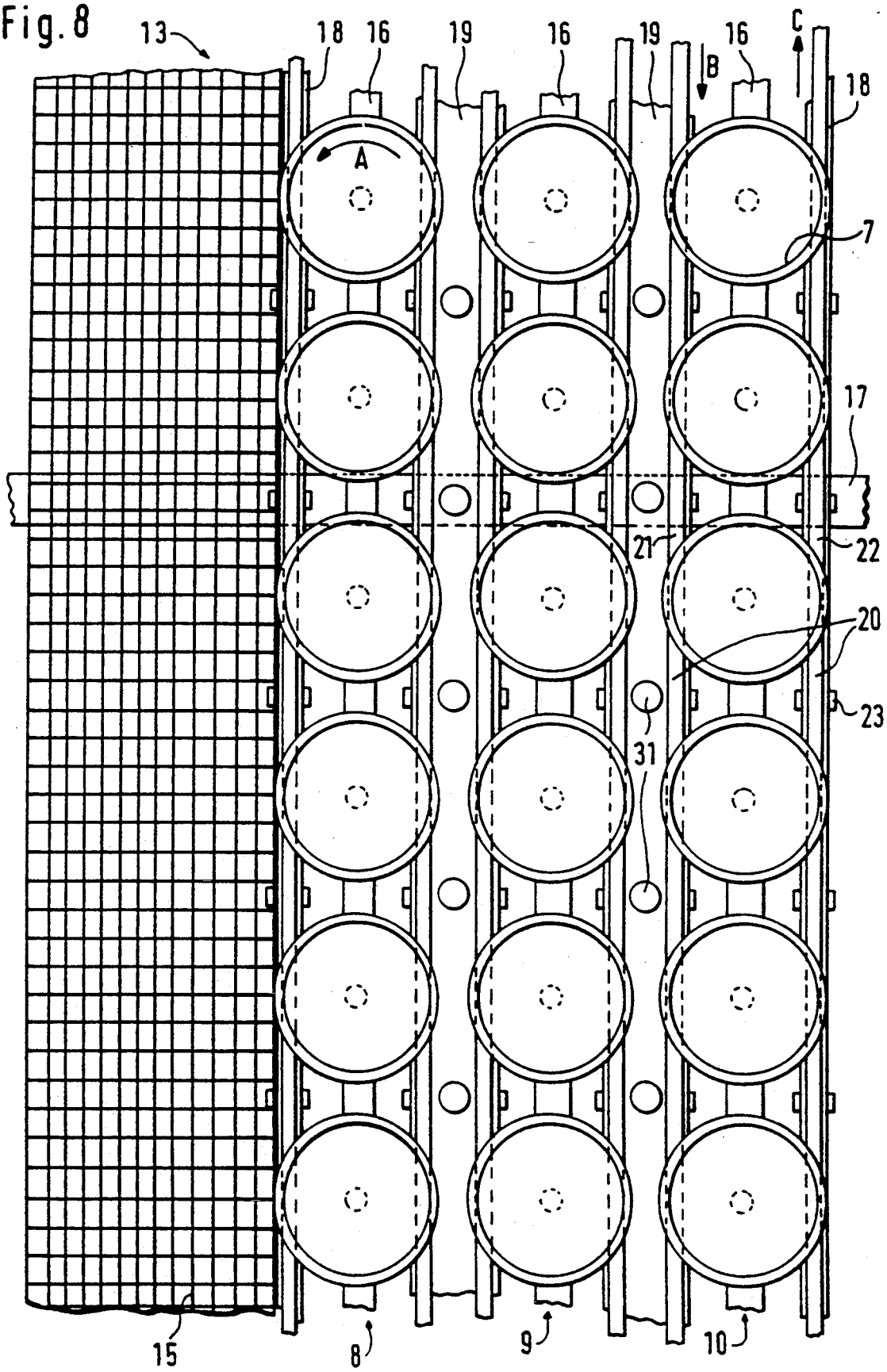
FIG. 8 is a top view of a portion of a platform which is enlarged in comparison to FIG. 1.

As shown in FIG. 8, which shows the embodiment according to FIGS. 1 and 2 in a slightly modified scale, all cans 7 rotate counterclockwise in the same direction indicated by the arrow (A). In this case, the runs 21, 22 of each driving belt 20 travel in the opposite direction indicated by the arrows (B and C).

In order to obtain a simpler guiding of the belts and reversing at the machine ends, it is provided in a modified embodiment (FIG. 5) that the driving belts 37, which may also be constructed as toothed belts, extend in the longitudinal direction of the spinning machines 1, 2 standing on edge. In this case, two longitudinal members 34, 35 respectively are provided which guide the driving belt 37 between one another. On their bottom side, these longitudinal members 34, 35 are connected with one another by means of transversely extending brackets 36.

In especially preferred embodiments, the grid 50,51 has at least 50% air permeability (ratio of open air space to closed floor space).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine system comprising:

at least one spinning machine which has a plurality of spinning stations arranged next to one another;

one sliver can respectively assigned to each spinning station, which sliver can contains a sliver to be spun, and a can support platform situated above the spinning machine, the cans being deposited in several rows in a depositing area on the can support platform, wherein the spinning machine system is an air-conditioned spinning room, and wherein the can support platform includes an operating aisle separate from the depositing area which has an air permeability that allows free circulation of air-conditioning air through the can support platform to thereby prevent warm air from backing up below the can support platform.

2. A spinning machine system according to claim 1, wherein the can support platform is provided with at least one operating aisle and a depositing area for the sliver cans, the operating aisle essentially comprising gridirons, and the depositing area comprising longitudinal members which extend in a longitudinal direction of the spinning machine and are arranged at a spacing from one another.

3. A spinning machine system according to claim 2, wherein a rotary drive, which is integrated into the grid construction of the platform, is provided for the sliver cans.

4. A spinning machine system according to claim 1, wherein a joint can support platform is provided for several spinning machines set up in parallel to one another, the can support platform being divided into depositing areas for cans which are situated centrically above the pertaining spinning machines and into operating aisles situated in-between.

5. A spinning machine system according to claim 4, wherein a rotary drive, which is integrated into the grid construction of the platform, is provided for the sliver cans.

6. A spinning machine system according to claim 1, wherein a rotary drive, which is integrated into the grid construction of the platform, is provided for the sliver cans.

7. A spinning machine system according to claim 6, wherein the platform comprises longitudinal members, and wherein the rotary drive includes driving belts extending in a longitudinal direction of the machine and having driving runs supported on the longitudinal members.

8. A spinning machine system according to claim 7, wherein the platform comprises a longitudinal member, and wherein the rotary drive comprises drivable sliver can plates on which the sliver cans can be deposited and which are disposed in a longitudinal member.

9. A spinning machine system according to claim 6, wherein the platform comprises a longitudinal member, and wherein the rotary drive comprises drivable sliver can plates on which the sliver cans can be deposited and which are disposed in a longitudinal member.

10. A spinning machine system according to claim 1, wherein said air-permeable grid construction has an air permeability of at least 50%.

* * * * *